US006814647B1

(12) United States Patent
Huang

(10) Patent No.: US 6,814,647 B1
(45) Date of Patent: Nov. 9, 2004

(54) ELECTROMAGNETIC WAVE PROOF CUP STRUCTURE FOR BRA

(76) Inventor: Shin-Heng Huang, No. 11, Lane 66, Huaide St. Beitou District, Taipei 112 (TW)

( * ) Notice: Subject to any disclaimer, the term of this patent is extended or adjusted under 35 U.S.C. 154(b) by 0 days.

(21) Appl. No.: 10/732,264

(22) Filed: Dec. 11, 2003

(51) Int. Cl.[7] ..... A41C 3/00
(52) U.S. Cl. ..... 450/39; 450/1; 2/267
(58) Field of Search ..... 450/1, 30–32, 450/53–57, 93, 39, 43, 41, 44, 46, 60; 2/267, 268, 2.5, 463, 464, 468, 48, 46, 50, 51, 243.1; 174/35 R, 356 C, 25 MC; 361/816, 818; 250/505.1, 515.1, 516.1, 519.1

(56) References Cited

U.S. PATENT DOCUMENTS 5,621,188 A * 4/1997 Lee et al. ..... 174/35 MS
5,690,537 A * 11/1997 Kalmus ..... 450/57
5,882,242 A * 3/1999 Hardy ..... 450/93
6,374,643 B2 * 4/2002 Orima ..... 66/193
6,398,620 B1 * 6/2002 Huang ..... 450/57
6,488,564 B1 * 12/2002 Gray ..... 450/57
6,665,877 B1 * 12/2003 Gray ..... 2/69

* cited by examiner

*Primary Examiner*—Gloria M. Hale
(74) *Attorney, Agent, or Firm*—Troxell Law Office PLLC

(57) ABSTRACT

An electromagnetic wave proof cup structure for bra includes a first layer, a second layer and an intermediate layer joined to the first and the second layers. The intermediate layer contains metallic fiber so as to screen the electromagnetic wave and the contact area between the breast and the bra cup can be reduced effectively to decrease the hurt resulting from electromagnetic wave. The intermediate layer includes a first sheet piece and a second sheet piece and the two sheet pieces are attached to two lateral sides of the bra cup respectively in a way of extending upward so that the breast can be held upward and centrally disposed in the bra cup.

6 Claims, 4 Drawing Sheets

ELECTROMAGNETIC WAVE PROOF CUP STRUCTURE FOR BRA

BACKGROUND OF THE INVENTION

1. Field of the Invention

The present invention relates to a brassiere, and particularly to a structure of bra cup in a brassiere to provide a function of resisting electromagnetic wave.

2. Description of Related Art

Most women wear a brassiere every day to support their breasts so as to provide a sense of beauty. There are a lot of inventions related to the brassiere and, for instance, Taiwanese Patent Publish No. 393906 discloses an improved structure of massage type brassiere, which provides a function of breast massage. Next, Taiwanese Patent Publish No. 3575553 discloses an improved structure of bra cup, which discloses a bra cup with magnets being sewed to the intermediate layer in proper places thereof for balancing the magnetic field of the human body. Further, Taiwanese Patent Publish No. 334693, which discloses an improved structure of magnetic brassiere, and Taiwanese Patent Publish No. 308804, which discloses a liquid adjustment type healthy magnetic wave brassiere, are provided with similar functions.

The electromagnetic wave has hurt the human body and typical career women face the screen when operating a computer every day. The electromagnetic waves are emitted from the computer, over a long period of time will adversely affect thier bodies Especially since, the breasts of women jut out of their bodies and are closest to the computer so that the risk of harm from the electromagnetic wave to the breast tissues can result in an abnormal pathology.

SUMMARY OF THE INVENTION

A primary object of the present invention is to provide a structure of bra cup, which has a capability of resisting electromagnetic wave.

Another object of the present invention is to provide a structure of bra cup, which has a function of centrally holding the breast upward.

BRIEF DESCRIPTION OF THE DRAWINGS

The present invention can be more fully understood by reference to the following description and accompanying drawings, in which.

DETAILED DESCRIPTION OF THE PREFERRED EMBODIMENTS

Figure 1:
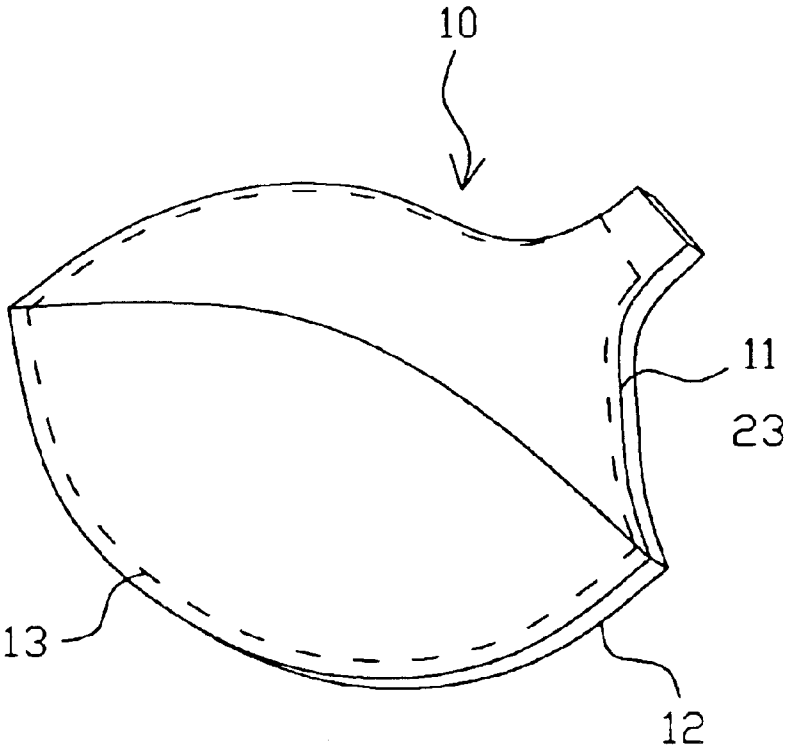
FIG. 1 is a perspective view of a bra cup of a first embodiment according to the present invention.
Figure 2:
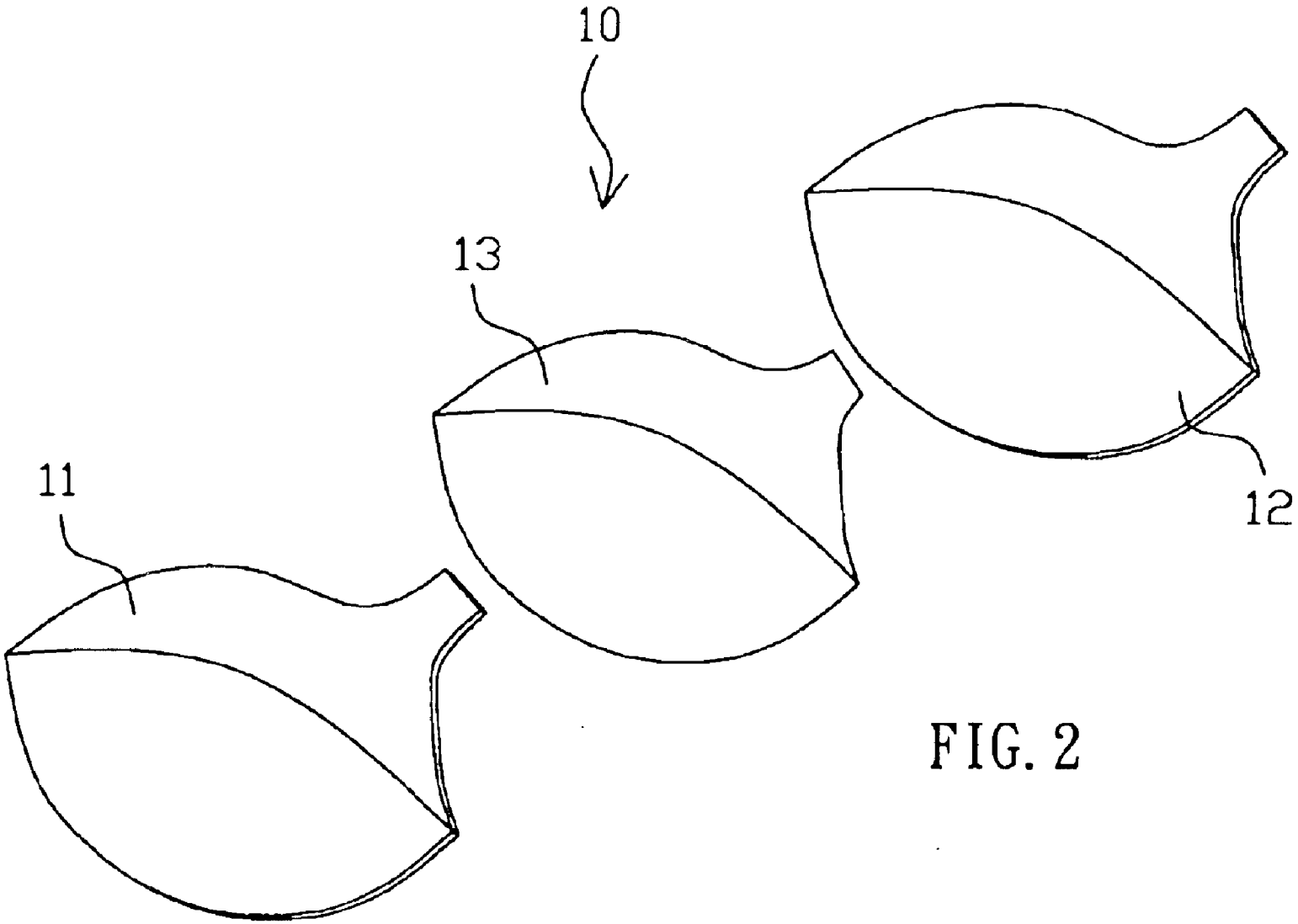
FIG. 2 is an exploded perspective view of the bra cup shown in FIG. 1.

Referring to FIGS. 1 and 2, the first embodiment of the bra cup 10 according to the present invention includes a first layer 11, a second layer 12 and an intermediate layer 13 and the first and the second layers 11, 12 are made of elastic material such as foam material. The intermediate layer 13 is disposed between the first layer 11 and the second layer 12 and joined to both the first and the second layers 11, 12 with adhesive. The intermediate layer 13 is woven with a mixture of stainless steel fiber and cotton thread and the stainless steel fiber occupies 5–25% of the bra cup and the cotton thread occupies the rest 75–95%. It is preferable that the stainless steel fiber occupies 10% and the cotton thread occupies 90%.

Because the metallic material provides a function of screening out electromagnetic wave, the bra cup 10 containing the intermediate layer 13 with the stainless steel fiber provides an effect of resisting the electromagnetic wave. Hence, it is capable of reducing the exposure of the breast to the electromagnetic wave so as to lower the risk of harm to the breast.

Figure 3:
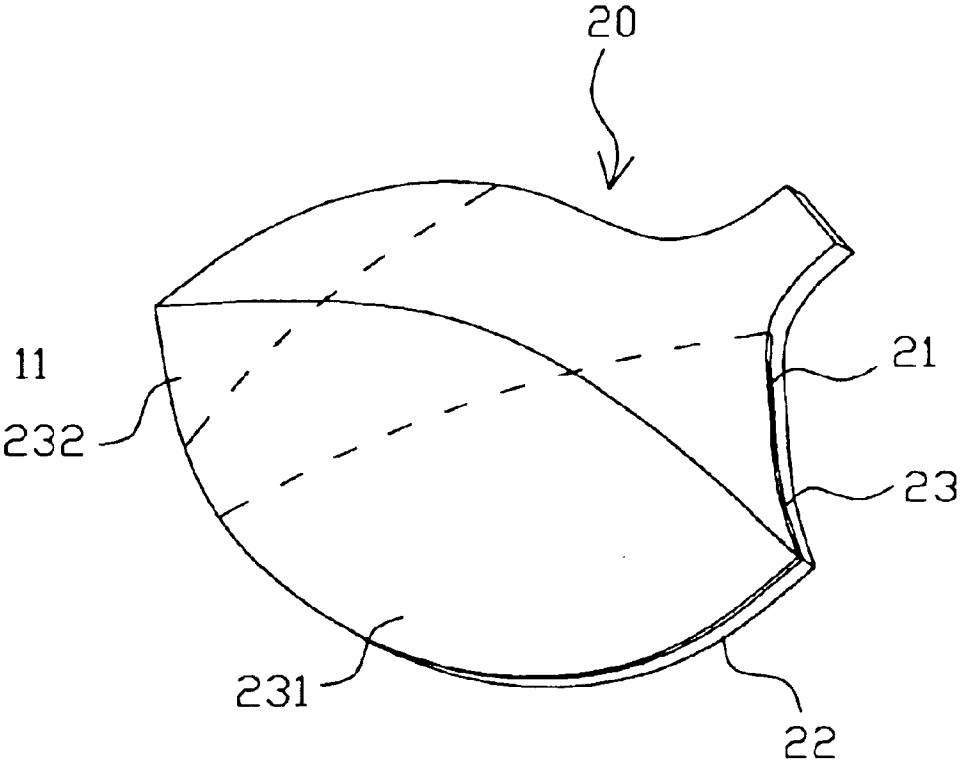
FIG. 3 is a perspective view of a second embodiment of a bra cup according to the present invention.
Figure 4:
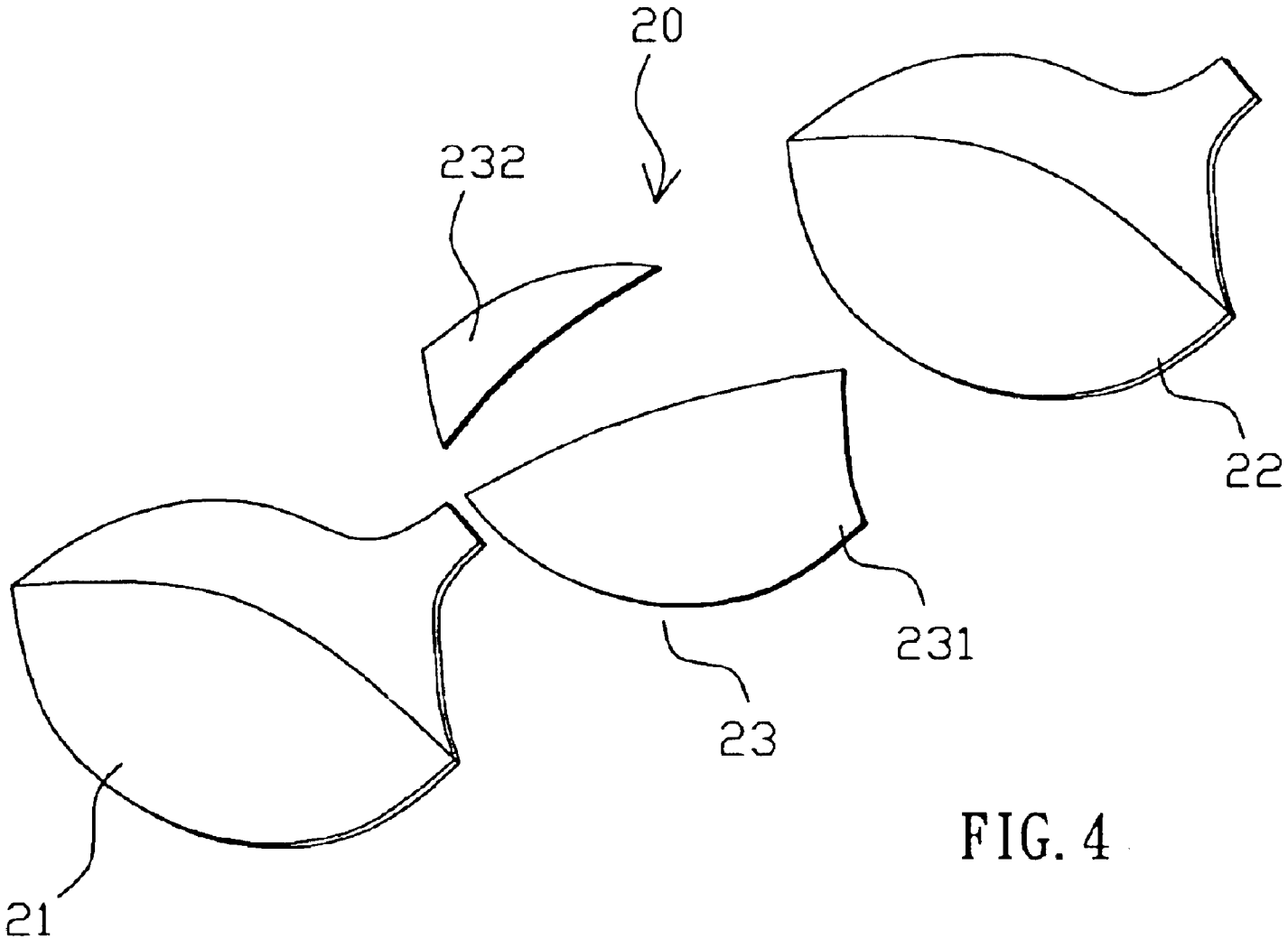
FIG. 4 is an exploded perspective view of the bra cup shown in FIG. 3.

Referring to FIGS. 3 and 4, the second embodiment of the present invention illustrates a bra cup 20, which includes a first layer 21, a second layer 22 and an intermediate layer 23. The first and second layers 21, 22 are made of elastic material such as foam material and the intermediate layer 23 is disposed between the first and the second layers 21, 22 and woven with an mixture of stainless steel fiber and cotton thread. The intermediate layer 23 further includes a first sheet piece 231 and a second sheet piece 232 and both the sheet pieces 231, 232 are separated from each other. The intermediate layer 23 is less elastic and ductile than the first and the second layers 21, 22 to allow the bra cup 20 providing a function of keeping the shape of bar cup. The first sheet 231 and the second sheet 232 are joined to two lateral sides of the bar cup 20 respectively and extend upwardly from the lower end thereof so that the breast can be held upward. Further, due to the first and the second sheets 231, 232, the breast can be held upward from two lateral sides thereof so as to be centrally disposed with sense of beauty.

Figure 5:
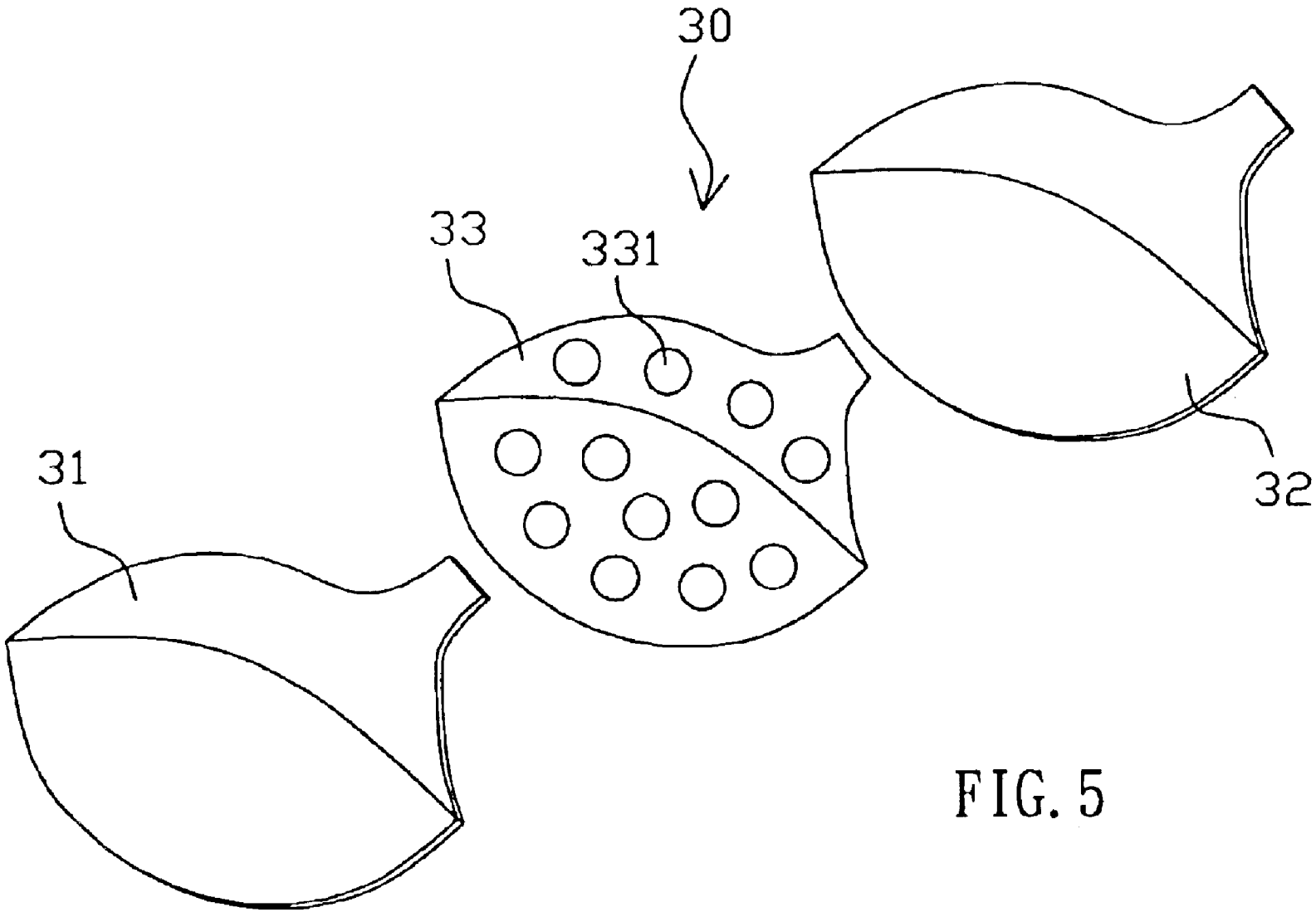
FIG. 5 is an exploded perspective view of a third embodiment of the bra cup according to the present invention.

Referring to FIG. 5, the third embodiment of the present invention illustrates a bra cup 30, which includes a first layer 31, a second layer 32 and an intermediate layer 33. The first and the second layers 31, 32 are made of elastic material such as foam and the intermediate layer 33 is disposed between the first and the second layers 31, 32 and woven by way of a mixture of stainless steel fiber and cotton thread. The intermediate layer 33 is provided with a plurality of air apertures 331 for enhancing ventilation.

It is noted that the intermediate layer can be fabricated by way of pressing instead of being woven and the cotton thread used can be taken place with non-metallic fiber such as fibers of animals or plants or chemical fibers. Further, it is not restricted that the size of the intermediate layer, the amount of the sheet pieces and the joining area between the first layer and the second layer are not restricted. In addition, gold, silver or other metallic fibers can be used instead of the stainless fibers as long as they are capable of resisting electromagnetic wave.

While the invention has been described with reference to the preferred embodiments thereof, it is to be understood that modifications or variations maybe easily made without departing from the spirit of this invention which is defined by the appended claims.

What is claimed is:

1. An electromagnetic wave proof cup structure for bra, comprising:

a first layer;

a second layer; and an intermediate layer, being disposed between and joined to the first and the second layers and containing metallic fiber, wherein the intermediate layer contains non-metallic fiber, wherein the intermediate layer is fabricated by way of a mixture of metallic and non-metallic fibers being woven as a flat piece, wherein the first and the second layers are made of elastic material and the intermediate layer includes a first sheet piece and a second sheet piece and both the sheet pieces are separated from each other with the first sheet and the second sheet being joined to two lateral sides of the bar cup respectively in a way of extending upward.

2. The electromagnetic wave proof cup structure for bra according to claim 1, wherein the middle fiber is stainless steel fiber.

3. The electromagnetic wave proof cup structure for bra according to claim 1, wherein the elastic material is foam material.

4. An electromagnetic wave proof cup structure for bra, comprising:

a first layer;

a second layer; and an intermediate layer, being disposed between and joined to the first and the second layers and containing metallic fiber, wherein the intermediate layer contains non-metallic fiber, wherein the intermediate layer is fabricated by way of a mixture of stainless steel fiber and cotton thread being woven as a flat piece, wherein the stainless steel fiber occupies 5–25% and the cotton thread occupies 75–95% in the intermediate layer.

5. The electromagnetic wave proof cup structure for bra according to claim 4, wherein the intermediate layer is provided with a plurality of air apertures.

6. An electromagnetic wave proof cup structure for bra, comprising:

a first layer;

a second layer; and an intermediate layer, being disposed between and joined to the first and the second layers and containing metallic fiber, wherein the intermediate layer contains non-metallic fiber, wherein the intermediate layer is fabricated by way of a mixture of stainless steel fiber and cotton thread being woven as a flat piece, wherein the stainless steel fiber occupies 10% and the cotton thread occupies 90% in the intermediate layer.

* * * * *